United States Patent [19]

Fitch

[11] 4,252,298

[45] Feb. 24, 1981

[54] SELF-MAINTAINING WINCHES

[75] Inventor: Clifford K. Fitch, London, England

[73] Assignee: Sten Engwall, Sweden

[21] Appl. No.: 948,541

[22] Filed: Oct. 4, 1978

[30] Foreign Application Priority Data

Nov. 12, 1977 [GB] United Kingdom ..... 47183/77

[51] Int. Cl.[3] ..... B66D 1/30

[52] U.S. Cl. ..... 254/371; 254/266

[58] Field of Search ..... 254/150 R, 138, 175.3, 254/175.5, 175.6, 175.7, 186 HC, 191; 242/155 R, 117, 125.1, 47.01, 47.09, 47.12; 74/230.24, 230.7; 114/218; 226/168

[56] References Cited

U.S. PATENT DOCUMENTS

| | | | |
|---|---|---|---|
| 3,520,492 | 7/1970 | Brown | 242/155 R |
| 3,841,606 | 10/1974 | Declercq | 254/150 R |
| 3,870,242 | 3/1975 | Schussel | 242/47.12 X |

FOREIGN PATENT DOCUMENTS

| | | | |
|---|---|---|---|
| 2427766 | 12/1975 | Fed. Rep. of Germany | 242/47.01 |

*Primary Examiner*—John M. Jillions

*Attorney, Agent, or Firm*—Holman & Stern

[57] ABSTRACT

A resilient ring is provided as an attachment to fit around the barrel of a winch for jamming the end turn of a loaded rope wound around the barrel against the adjacent turn thereby obviating the need to apply manual tension to the tail of the rope.

14 Claims, 10 Drawing Figures

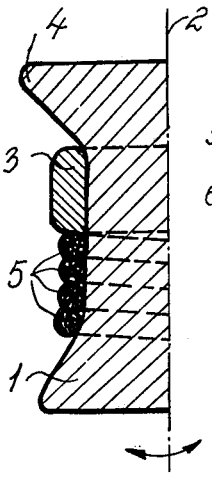
Fig. 1
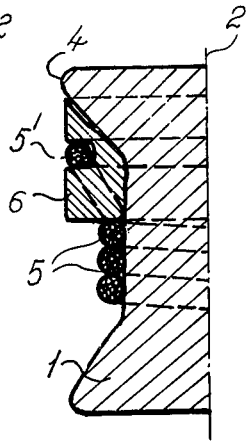
Fig. 2
Fig. 3
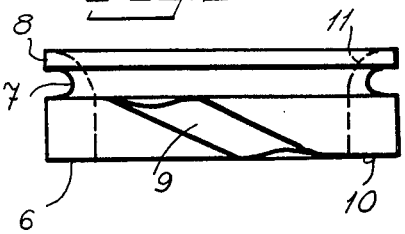
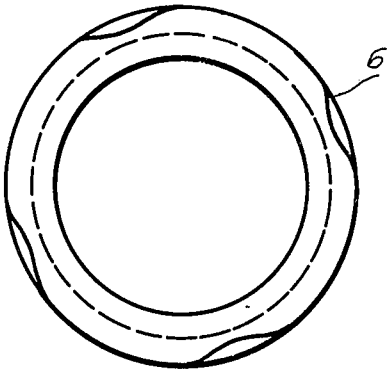
Fig. 4
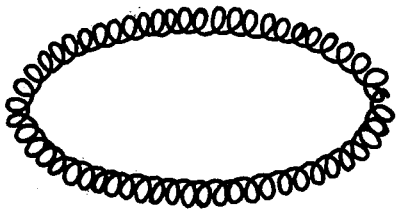
Fig. 7
Fig. 10
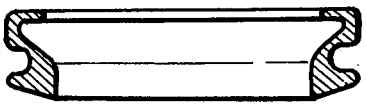
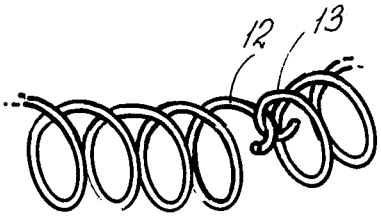
Fig. 8
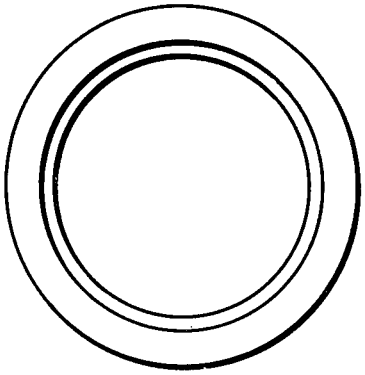
Fig. 9

SELF-MAINTAINING WINCHES

BRIEF SUMMARY OF THE INVENTION

This invention relates to winches, to methods of operating winches and to accessories for winches and is particularly concerned with self-maintaining winches.

Self-maintaining winches in accordance with the invention are particularly suitable for use on yachts. In particular, sheet winches are used on yachts to increase the tension which may be applied to the foresail sheet. Such a winch is normally arranged with the axis of the barrel vertical, and, in use, a number of turns (for example 4) of the sheet are placed around the winch barrel, the bottom turn leading to the sail, and the top turn being manually held. So long as the top turn is held tight, force may be applied to the sheet by rotating the winch barrel. However, if the tension is removed from the top turn, the sheet will slip around the winch barrel until tension is restored. It is frequently difficult for one operator to maintain the tension in the tail and, at the same time, to operate the winch. Accordingly, it is an object of the invention to enable the winch to be operated without the necessity for manually maintaining tension in the tail.

From one aspect the invention consists in a winch having a barrel and an annular resilient member removably fitted on said barrel adjacent one end thereof.

When a winch in accordance with this aspect of the invention is in use, a plurality of turns (for example 4) of the sheet are placed on the winch barrel with the turn leading to the tail adjacent to the annular resilient member. If tension is initially put on the tail, it will be found that the turn leading to the tail will be jammed between the annular resilient member and the adjacent turn and, accordingly, the turns will not slip on the barrel even if the tension is removed.

Thus, from another aspect the invention consists in a method of operating a winch wherein a first end turn leading to a load, a second end turn leading to a tail, and at least one intermediate turn are placed around the winch barrel and wherein said second end turn is jammed between an annular resilient member removably fitted on said barrel and said intermediate turn or the adjacent one of a plurality of intermediate turns.

The annular resilient member may take a number of different forms and, in particular, may be constituted by a helical spring ring. In this embodiment, the helical spring is placed around the barrel, and the two ends of the spring are joined together so that it forms a ring surrounding the barrel. The joint between the ends of the spring is preferably such that the pitch is constant throughout the join, but this characteristic should be achieved without making the ends difficult to seperate and join. Preferably the diameter of the spring helix is greater than the diameter of the sheet or rope to be used on the winch.

Some winches are provided with a flat flange at at least one end of the barrel and, in this case, axial movement of the annular resilient member along the barrel away from the turn leading to the tail is limited by the flange. In most winches, however, of the kind usually used on yachts, the barrel itself is flared outwardly at at least one end. In the case of a winch of this kind, the axial movement of the annular resilient member along the barrel is limited by the force required to stretch the member sufficiently to allow it to travel up the flared part of the barrel. In either case, when the limiting position is reached, it will be understood that the end turn leading to the tail is jammed between the resilient member and the adjacent turn. If the dimension of the resilient member in the radial direction with respect to the winch barrel is greater than the diameter of the rope wound on the barrel, there will be no tendency for the rope to ride over the resilient member and, accordingly, it will be securely jammed. In the particular case of the helical spring ring previously referred to, the diameter of the helix may be, for example, 2 cm when it is used with rope having a diameter of 1.15 cm.

In another particular case, the spring is wound from spring temper stainless-steel having a diameter of 2.64 mm and the diameter of the helix is 18.415 mm. In any case, the ratio of the helix diameter to the rope diameter is preferably substantially 8:5. The length of the helix is preferably such that, when it is in position on the barrel, its length is increased by approximately 10% from its unstretched length.

In another example of the invention, the resilient member is in the form of a ring of elastomeric material such as rubber. The elastomeric ring may have a circular cross-section, but preferably has a dimension in the axial direction of the barrel greater than its dimension in the radial direction. In a particular embodiment of this form of the invention, the ring has an external circumferential groove and a plurality of channels leading into the groove from one edge of the ring, these channels being inclined with respect to the groove.

Accordingly, from yet another aspect the invention consists in a winch accessory comprising a ring of elastomeric material having an external circumferential groove and a plurality of channels distributed around the circumference of the ring and leading into said groove from one edge of the ring, said channels being inclined with respect to said groove.

It is to be understood that, when an accessory in accordance with this aspect of the invention is in use, it is mounted on the winch barrel with the circumferential groove in the vicinity of one end of the barrel, this end being, in the case of sheet winches, the upper end. Three or four turns of the sheet are laid on the barrel below the ring, and the tail of the sheet will enter the circumferential groove via one of the channels. It is, of course, to be understood that the channels are inclined in the direction necessary to promote easy entry of the sheet into the circumferential groove.

In any form of the invention in which the resilient member is in the form of a ring of elastomeric material, the edge of the ring which, in use, is adjacent to one end of the barrel, is preferably shaped so that it is in contact with the flange or flare of the barrel. In the particular embodiment in which the ring has a circumferential groove, the dimensions of the groove are preferably adapted to the diameter of the rope with which the ring is to be used.

BRIEF DESCRIPTION OF THE SEVERAL VIEWS OF THE DRAWING

Methods of performing the invention will be described with reference to the accompanying diagrammatic drawings, in which:

FIG. 1 is a side view of a first embodiment of a winch in accordance with the invention;

FIG. 2 is a side view of a second embodiment of a winch in accordance with the invention;

FIG. 3 is a side view of a winch accessory of the kind used on the winch illustrated in FIG. 2;

FIG. 4 is an underneath plan view of the accessory shown in FIG. 3;

FIG. 7 is a perspective view of a modified form of accessory for use on the winch in accordance with the invention; and FIG. 8 is an enlarged view of a portion of the accessory shown in FIG. 7.

FIG. 9 is a plan view of a modified form of accessory used on the winch in FIG. 2.

FIG. 10 is cross section of FIG. 9.

DETAILED DESCRIPTION

Figure 5:
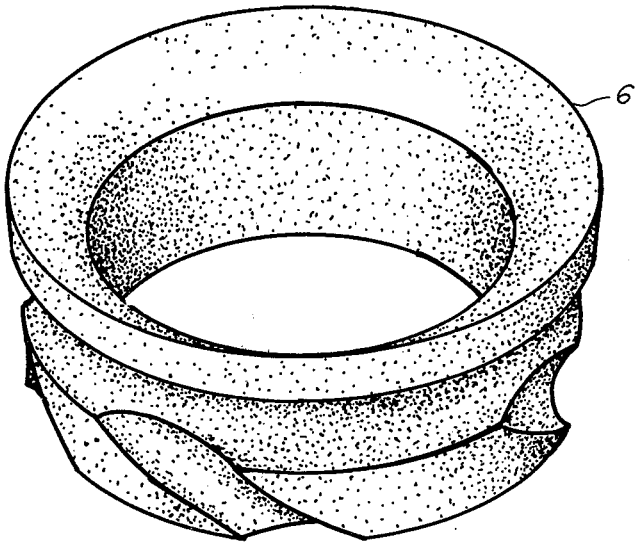
FIG. 5 is a perspective view from above of the accessory shown in FIGS. 3 and 4.

The winch illustrated in FIG. 1 includes a winch barrel 1 having means (not shown) for rotating the barrel about an axis 2, as indicated diagrammatically by the arrow. The winch also includes a rubber ring 3 which is sufficiently resilient to enable it to be pulled over the upper flange 4 of the winch barrel.

When the winch illustrated is in use, four turns of rope 5 are placed around the barrel below the rubber ring 3. The lowermost turn leads to the sail, or other load, while the uppermost turn leads to a tail which would normally have to be held in one hand by the user. However, in the present case, the tail is automatically held by the rubber ring 3. The rubber ring will tend to be forced upwards on the drum by the turns of the rope, but the tension in the rubber ring will counteract this motion, and the turns of the rope will be pressed on to the drum and against each other. As is known, the turns of rope on the barrel are subject to a type of servo action such that the tension in the lowermost turn is very much greater than the tension in the uppermost turn. Thus only a relatively low force is required to lock the uppermost turn on the barrel and a very heavy load may be applied to the lowermost turn. In one particular test, for example, the load applied to the lowermost turn was 2000 lb.

In one particular example, the dimensions of the cross-section of the rubber ring may be $1\frac{3}{8}$in$\times\frac{5}{8}$ in, and, in another case, the section is $1\frac{3}{8}$in$\times\frac{1}{2}$ in. A ring with the latter dimensions is easier to stretch over the top flange 4 and, in most instances, will support as great a load as the wider ring.

Figure 6:
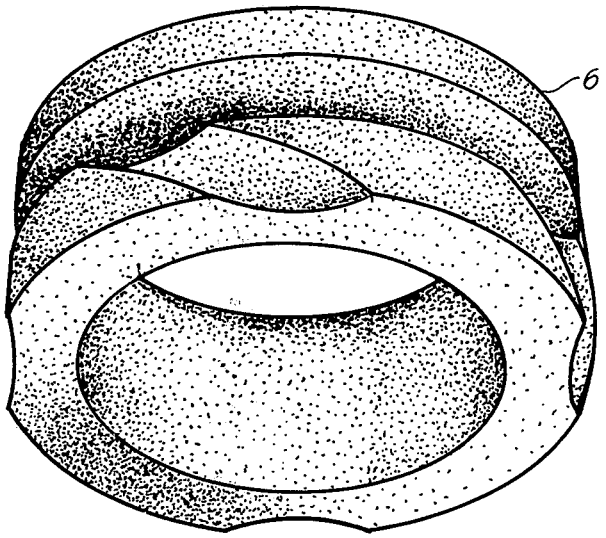
FIG. 6 is a perspective view from below of the accessory shown in FIGS. 3, 4 and 5.

FIG. 2 illustrates a second embodiment of the invention, again incorporating a winch barrel 1 having an upper flange 4, and rotatable about an axis 2. In this case, however, the rubber ring 3 is replaced by a ring 6 of the kind illustrated in FIGS. 3, 4, 5 and 6. This ring includes a peripheral groove 7 near to the upper edge 8 of the ring, and four inclined channels 9 leading from the lower edge 10 of the ring into the groove 7. The inner surface of the ring is shaped as shown, for example, by the dashlines 11 in FIG. 3 to fit the flange 4 of the winch barrel.

When a winch in accordance with this second embodiment of the invention is in use, a number of turns of rope 5 are intially placed over the winch barrel below the rubber ring 6, and a further turn is then caused to enter one of the channels 9. This leads the tail end of the rope into the groove 7, and rotation of the winch causes the rope to follow round the groove 7 as shown by the turn 5′ in FIG. 2. This particular construction of the rubber ring has been found to enable turns of rope to be put on to the winch and locked in position very quickly.

While only four channels 9 have been shown in the drawings, it is, of course, to be understood that a larger number of channels may be provided if desired. It is also to be understood that the dimensions of the groove 7 should be chosen to suit the rope with which the winch is to be used. On the other hand, the width of the channels 9 can, if desired, be made larger than the width of the groove, although, in general, it is preferred that they should not be as deep as the groove.

Preferably the hardness of the rubber ring used in either of the embodiments hereinbefore described should be between 60 and 65 Shore.

The rubber rings shown in the first two embodiments of the invention may be replaced by metal springs, for example, of the kind shown in FIGS. 7 and 8. As previously mentioned, it is desirable that the pitch of the spring should be constant throughout its length, although this is not particularly easy to achieve in the region of the joint between the two ends of the spring. However, the arrangement shown in FIG. 8 provides a reasonable solution to this problem. As can be seen, the two ends of the spring 12 and 13 are bent into loops of the same radius as the remainder of the spring, each loop, however, being contained in a plane normal to the plane of the preceding loop. The two loops forming the joint should be as complete as possible without making it too difficult to insert one through the other when the spring is fitted on the winch barrel.

Preferably the wire used for the spring is relatively thick and the diameter of the helix is preferably greater than that of the rope with which the winch is to be used. It will be understood that the top turn of the rope is held in position and gripped between the spring, the winch barrel, and the next turn of rope. This constitutes a triangle of force serving to prevent movement between the rope and the winch barrel. Preferably the length of the spring should be such that it fits about one third of the way up the winch barrel with the length of the spring increased by about 5% from its unstretched length.

Preferably the spring consists of spring-temper stainless steel wire and, in one particular instance, the wire diameter was 2.64 mm. The spring diameter may be, for example, 18.415 mm, and the pitch may be 6.35 mm.

If desired, the single spring shown in FIG. 7 may be replaced by a series of shorter springs hooked together by joints similar to that shown in FIG. 8.

In a modification of the arrangement shown in FIG. 7, the spring is replaced by a braclet of beads threaded on wire or on a small-diameter helical spring.

In a modification of the arrangement shown in FIG. 1, the dimensions of the rubber ring 3 are reduced, and the ring is twisted a number of times throughout its length. In this case, the ring may be formed from a strip of rubber, the two ends of which are held together by metal clips.

The modification of the accessory shown in FIGS. 9 and 10 is a rubber ring to be fitted over the upper flange of the winch barrel.

What is claimed is:

1. A winch assembly having a barrel with at least one flange, a rope wound around the barrel, said rope having a first end turn leading to a load and a second end turn leading to a tail, said second end turn being adjacent to said flange, and an annular resilient member movably fitted on said barrel between said flange and said second end turn so that one side of said resilient member engages against said flange and the other side is engaged by said second end turn.

2. A winch assembly according to claim 1 wherein said annular resilient member is a rubber ring.

3. A winch as claimed in claim 2, wherein said rubber ring is provided with an external circumferential groove and a plurality of channels distributed around the circumference of the ring and leading into said groove from one end of the ring, said channels being inclined with respect to said groove.

4. A winch assembly according to claim 1 wherein said annular resilient member engages said flange and is provided with an external circumferential groove.

5. A winch assembly according to claim 1 wherein said annular resilient member is a helical spring.

6. A winch assembly according to claim 1 wherein said annular resilient member is a strip of rubber or like resilient material.

7. A method of operating a winch wherein a rope having a first end turn leading to a load, a second end turn leading to a tail, and at least one intermediate turn is placed around the winch barrel and wherein said second end turn is jammed between an annular resilient member removably fitted on said barrel and said intermediate turn or the adjacent one of a plurality of intermediate turns.

8. A method as claimed in claim 7, wherein said annular resilient member is a rubber ring.

9. A method as claimed in claim 8, wherein the hardness of the rubber is between 60 and 65 Shore.

10. A method as claimed in claim 8 or claim 9, wherein said rubber ring is provided with an external circumferential groove and a plurality of channels distributed around the circumference of the ring and leading into said groove from one end of the ring, said channels being inclined with respect to said groove.

11. A method as claimed in claim 10, wherein the width and depth of said groove are slightly less than the diameter of the rope wound on the winch.

12. A method as claimed in claim 7, wherein said annular resilient member is a helical spring ring.

13. A method as claimed in claim 12, wherein the diameter of the spring helix is greater than the diameter of the rope wound on the winch.

14. A method as claimed in any of claims 7, 8, 9, 12 or 13, wherein the axis of the winch is substantially vertical and the annular resilient member is fitted near the upper end of the barrel.

* * * * *